US008368318B2

(12) United States Patent
Kuster

(10) Patent No.: US 8,368,318 B2
(45) Date of Patent: Feb. 5, 2013

(54) POCKET TOOL WITH A LIGHT POINTER

(76) Inventor: Martin Kuster, Walchwill (CH)

( * ) Notice: Subject to any disclaimer, the term of this patent is extended or adjusted under 35 U.S.C. 154(b) by 238 days.

(21) Appl. No.: 12/668,742

(22) PCT Filed: Jul. 14, 2008

(86) PCT No.: PCT/EP2008/005725
§ 371 (c)(1),
(2), (4) Date: Jun. 8, 2010

(87) PCT Pub. No.: WO2009/010255

PCT Pub. Date: Jan. 22, 2009

(65) Prior Publication Data

US 2010/0237796 A1 Sep. 23, 2010

(30) Foreign Application Priority Data

Jul. 13, 2007 (AT) ..... A 1103/2007
Jul. 13, 2007 (DE) ..... 20 2007 009 934 U

(51) Int. Cl.
*H05B 33/08* (2006.01)

(52) U.S. Cl. ..... 315/291; 362/119

(58) Field of Classification Search ..... 315/291; 362/119, 253, 109, 295
See application file for complete search history.

(56) References Cited

U.S. PATENT DOCUMENTS 5,267,414 A 12/1993 Vaida
6,027,224 A 2/2000 Schnell
7,059,741 B2 * 6/2006 Elsener ..... 362/119
7,125,145 B2 * 10/2006 Gardiner et al. ..... 362/253
2001/0034910 A1 11/2001 Taggart et al.
2004/0182929 A1 9/2004 Aoshima
2006/0087845 A1 4/2006 Yeh
2007/0008665 A1 1/2007 Moyer et al.

FOREIGN PATENT DOCUMENTS

DE 4327343 A1 8/1993
DE 29820727 U1 11/1998
DE 202004001358 U1 1/2004
EP 0431832 A2 11/1990
JP 7135362 A 5/1994

* cited by examiner

*Primary Examiner* — Daniel D Chang
(74) *Attorney, Agent, or Firm* — Kilpatrick Townsend & Stockton LLP

(57) ABSTRACT

The invention relates to a compact light module (1), that is eye-safe as far as possible, comprising an electrical power source (2), a voltage converter (3) and a radiation source for electromagnetic radiation (4), wherein a power limiter (5) is provided for controlling the emitted electromagnetic radiation. The invention also relates to a pocket tool, in particular a pocket knife (26) or board-like tool card (31) with a light module (32) for emitting electromagnetic radiation which is arranged in the housing (27) and can be operated by means of an activating element (30), whereby the light module (32) is designed to emit monochromatic electromagnetic radiation with limited radiation output.

17 Claims, 3 Drawing Sheets

POCKET TOOL WITH A LIGHT POINTER

The invention relates to a compact light module, which is safe for eyes as far as possible, comprising an electrical power source, a voltage converter and a radiation source for electromagnetic radiation. Furthermore, the invention relates to a pocket tool, in particular a pocketknife or board-like tool card, which comprises a housing with at least one mounting area and at least one functional element which can be moved out of a storage position in the mounting area into a position of use outside the mounting area, and with a light module for emitting electromagnetic radiation, which is arranged in the housing and can operated by means of an activating element.

In the case of tools that are used daily, in particular pocket tools, it is often desirable for a light module to be arranged on or in said tool. Such a light module can be designed for example to illuminate the operating area of the hand tool or to function as a light pointer. Owing to the often only very small amount of space available in hand tools the lighting element mostly consists only of a power supply and a lighting means, a control circuit or safety circuit is not included due to lack of space. The power supply is mostly provided by a chemical element, in particular a standard battery. However, chemical elements have the disadvantage that the output voltage provided changes during operation, in particular it becomes continually lower; this drop in voltage is described by the so-called discharge curve. An additional advantage is that the discharging curve is dependent on the type of chemical element provided. In particular, chemical elements are known which have a continually decreasing output voltage, however there are also elements in which the output voltage remains largely constant for a long period but drops abruptly towards the end of their lifetime. However, a light module should emit a constant optical light for the entire period of operation which cannot be achieved by means of such a power supply.

As the output voltage of the chemical elements is also technologically limited, since many lighting means require a supply voltage which is higher than the output voltage of an individual chemical element, several chemical elements are used for example connected in series. It is also possible to convert the low output voltage of the chemical element by means of a voltage converter to the required increased output voltage of the lighting means. Such a voltage converter is mostly characterised in that it increases the input-side supply voltage by a specific fixed factor and makes it available on the output side.

However, known solutions have the disadvantage, that in the case of the improper or malicious use of an inappropriate power source, in particular one with a higher output voltage, the supply voltage is too high for the lighting means, which means that the lighting means can become damaged or destroyed. By increasing the supply voltage to the lighting means it is also possible that the electromagnetic radiation emitted thereby may exceed a power limit, and thus when illuminating the human eye with the emitted light beam the retina may be damaged by the high radiation.

U.S. Pat. No. 5,627,414 A discloses a folding pocket knife with a laser pointer. The laser pointer is designed such that a laser diode and several battery cells are arranged in a housing part that pivots out of the pocket knife. The laser diode is operated in that an activating element closes the circuit between the battery cells and the laser diode. With a closed circuit the power supply of the laser diode is the same as the output voltage of the battery cells connected in series.

U.S. Pat. No. 6,027,224 A also discloses a pocket tool, which comprises two lighting means. One lighting means is designed as a laser pointer, the second lighting means is designed as a lighting means which emits a cone of light. The document discloses that with a closed circuit, the first or second lighting means is connected directly to the battery cells.

Similar embodiments are also disclosed in US 2001/0034910 A1 and DE 298 20 727 U1.

The objective of the invention is to design a compact light pointer, such that with proper use the unwanted effect of electromagnetic radiation emitted by the lighting means on the human eye and damage to the retina is reliably avoided. In particular, the objective of the invention is to ensure this eye protection as far as possible even in the case of improper or incorrect use of the light pointer. The invention also relates to a pocket tool comprising a compact light pointer, in which damage to the eye caused by a light beam emitted by the light pointer is avoided as far as possible.

The objective of the invention is achieved in that a power limiter is provided to control the emitted electromagnetic radiation. The power of the electromagnetic radiation emitted by the radiation source is usually dependent on the supply voltage provided at the radiation source. The manufacturer of the voltage source usually indicates a maximum supply voltage at which the emitted electromagnetic radiation does not exceed a specific power limit. Based on the physiological properties of the human eye the optical radiation output is classified on the basis of the radiation wavelength. In this case in lighting means, which can be used in public without additional protection, or are used in public, the radiation output has to be so low that the natural protection mechanism of the eye (lid closing reflex) is sufficient to protect the retina from damage even with direct illumination of the eye.

The power limiter according to the invention can take into consideration a plurality of operating requirements and thus maintain the power of the emitted radiation in each case below a dangerous limit. The user of a light module according to the invention can thus be certain that in every operating state the electromagnetic radiation emitted is not dangerous for the eye.

To control the emitted electromagnetic radiation it is an advantage if the power limiter comprises a first detecting element for electromagnetic radiation. Said first detecting element can be designed for example to measure the power of the electromagnetic radiation emitted by the radiation source. It is a huge advantage that the power limiter identifies the currently emitted radiation at any time. Owing to the technological structure of the radiation source the emitted radiation is subject to an ageing process, i.e. the emitted radiation output changes even with constant supply voltage during the operating period. Furthermore, the emitted radiation output is mostly dependent on the temperature of the radiation source. Knowledge of the currently emitted radiation output is therefore of considerable importance to the design of a light module that is eye-safe.

A power limiter which comprises a control loop, has the very definite advantage that said power limiter can continually evaluate determined operating data and can influence the emitted radiation output specifically via the control loop. In contrast to parameter-based control a control loop has the advantage that a continual adjustment of the radiation output is possible within the meaning of a reference-actual value comparison.

In an advantageous development said control loop can comprise a protective circuit, which when a power limit is exceeded ensures a reliable disconnection of the radiation source.

A particularly efficient way of determining the emitted radiation output is achieved if the first detecting element is designed as a photodiode. Photodiodes have the particular advantage that their spectral efficiency can be adjusted very precisely. In this way it is possible for example to suppress the surrounding electromagnetic radiation as far as possible and measure only the output of electrical radiation emitted by the radiation source. Fluctuations in the surrounding brightness thus do not influence the identification of the emitted radiation output.

In an advantageous development the first detecting element can also be designed as a photo resistor or phototransistor. In particular, all detection elements are possible, which due to incoming electromagnetic radiation emit an electrical output signal or change the electrical parameters.

A significant advantage is achieved if the first detecting element and the radiation source are integrated into one module. Said advantageous design makes it possible to determine the power of the emitted electromagnetic radiation directly at the radiation source, whereby in particular disruptive, environmental influences falsifying the measurement are reduced. The embodiment also has the advantage that by means of modern technologically possible high integration density a very compact structure can be obtained for the module according to the invention. With respect to obtaining widespread usage and high production quantities the embodiment according to the invention has the additional advantage that the module can be produced particularly inexpensively.

In an advantageous development the radiation source and the first detection element can be adjusted to one another, whereby the emitted radiation output can be maintained very precisely.

According to one development the first detecting element and the radiation source can be formed by semiconductor elements. If the two elements are integrated into one module both elements have the same temperature, which is especially significant with regard to the common-mode parameters of semiconductors.

As the output of electromagnetic radiation emitted by the radiation source is usually dependent on the supply voltage of the radiation source, a significant and advantageous development is achieved if the power limiter is designed to influence the output voltage of the voltage converter. By means of this advantageous embodiment the power limiter is able by controlling the output voltage of the voltage converter to influence the output of the emitted electromagnetic radiation. A further advantage of an embodiment according to the invention is that the output voltage of the voltage converter is largely independent of the output voltage of the power source.

It is particularly advantageous if the voltage converter is a step-up and/or step-down converter. This makes it possible to convert a large output voltage range of the power source to the required, stable supply voltage of the radiation source. In particular, by means of a design according to the claims, even with a reduced output voltage of the power source a reliable and stable supply of the radiation source is achieved. The voltage converter operates in this operating state as a step-up converter.

An essential advantage in the embodiment of an eye-safe light module is achieved if the voltage converter is also designed as a step-down converter. Inappropriate use of the light module, for example using a power source for which the output voltage is too high, would cause the radiation source to emit electromagnetic radiation that is too high, whereby in the case of unintentionally illuminating the eye damage may be caused to the retina, as the permissible output limit is exceeded. By means of a voltage converter designed as a step-down converter it is ensured reliably, that even when using an inappropriate power source with a higher output voltage, the radiation source is supplied reliably with a maximum supply voltage, whereby in any case the output of the emitted electromagnetic radiation remains below a maximum permissible limit. In particular, a voltage converter designed according to the invention is in a position to reduce an input voltage which is up to 400% above the nominal value, to a limit-value conforming supply voltage of the radiation source.

A further advantage of the voltage converter designed according to the claims is that the voltage conversion is performed with very little loss. Particularly with mobile devices, it is crucial that the restricted amount of energy from the power source is converted in an optimum manner into electromagnetic radiation. Precisely for voltage adjustment from a higher to a lower voltage level a step-down converter designed according the invention has the advantage that the voltage adjustment does not require a resistant voltage divider which consumes energy.

It is also an advantage that adjustment to a level of input voltage that is too high or too low by the voltage converter is performed automatically without intervention. Thus even with the deliberate manipulation of the power source it is always ensured that the emitted electromagnetic radiation does not exceed a harmful output limit.

The emitted radiation output of a radiation source is also mostly dependent on the temperature of the radiation source. By means of the development according to the claims in which the power limiter comprises a temperature detection module, the advantage is achieved that changes to the emitted radiation output caused by the varying operating or surrounding temperatures of the light module can be balanced out. The operation of the radiation source causes the latter to mostly warm up, whereby the so-called working point can be displaced and thus the emitted radiation output can exceed an output limit. In addition, the radiation source can be heated further by the increased emitted radiation output, which can lead to an amplifying process, which can cause damage or disruption to the radiation source.

In an advantageous development the temperature detecting element can be designed to switch off the radiation source if the latter overheats and thus prevents damage to the radiation source.

A radiation source can generally emit electromagnetic radiation in a greater output range. In previously known devices the maximum output of the emitted electromagnetic radiation is determined in that the power source emits a maximum voltage, in particular an open-circuit voltage of generally used chemical elements, connected in series if necessary. An embodiment according the claims in which the power limiter has a power configuration module has the considerable advantage that the configuration of the emitted radiation output no longer depends on imprecise and modified voltage values. By means of the output configuration module it is ensured in an advantageous manner that unauthorised operation or manipulation of the radiation source is prevented.

A particularly advantageous development is achieved according to the invention in that in the output configuration module operating parameters are stored for the radiation source. By means of said operating parameters a clear and unchangeable configuration of the radiation source is possible, in particular in this way the safety-relevant output limit of the emitted radiation can be defined. Said operating parameters can be stored safely in the output configuration module, such that manipulation by unauthorised third parties can be prevented which is a considerable advantage with regard to the desired eye-safety.

An embodiment of the radiation source as a laser diode has the advantage that the emitted monochromatic electromagnetic radiation has a high intensity. Laser diodes due to their technical construction have the advantage that the emitted light beam is particularly suitable for forming a light pointer, as mostly only less expensive collimator lenses are required.

Because of the high light intensity of the emitted light beam, the diameter of which is mostly the size of the opening width of the pupil of an eye, it is very important to limit the output of the light beam to prevent damage in case of unintentional contact with the retina.

Lasers are classified according to their risk to humans, so that classes 1 and 2 according to EN 60825-1 are considered largely safe for the human eye. However, if used incorrectly, for example by inserting magnifying glasses or binoculars, damage can be caused to the retina by lasers even in the safe class 1 or 2.

A laser diode emitting electromagnetic radiation with a wavelength of 600 nm to 750 nm, preferably 655 nm, has the particular advantage that the emitted radiation lies within the visible optical range, also laser diodes which radiate in the range are widespread and thus inexpensive. Owing to the physiology of the eye a red light beam has the additional advantage that it can be seen clearly even at a lower radiation output. It is also an advantage that a laser diode designed according to the invention is used in many mass-produced articles and thus also the additionally required peripheral components are available at low cost.

A significant advantageous development is achieved when a cylinder attachment is arranged on a flange-like section of the laser diode. In the case of laser diodes it is known that they emit a strongly divergent and non-circular symmetrical beam. To achieve a beam that extends as far as possible with low beam spread a beam shaping optical system is mostly arranged after the laser diode. To prevent unwanted lateral radiation to mechanically secure the beam shaping optical system the laser diode is generally arranged in a cylindrical attachment. A disadvantage of such an arrangement is that the inner diameter of the cylinder attachment has to be large enough to mount and secure the laser diode. To achieve the required mechanical stability of the cylinder attachment the latter has an outer diameter which is much greater than the greatest outer diameter of the laser diode, which is a disadvantage for a compact structure.

In the embodiment according to the claims the cylinder attachment is arranged on a flange-like section of the laser diode, thereby achieving a significant reduction in the external diameter of the cylinder attachment, in particular the external diameter of the thus designed lighting element is the same as the maximum diameter of the laser diode.

A further advantage of the embodiment according to the invention is that owing to the greater contact area between the housing of the laser diode and the cylinder attachment the removal of heat from the laser diode can be improved.

In order to obtain a far-reaching light beam that is circle-symmetrical as far as possible, it is an advantage if a beam shaping optical system is arranged in the cylinder attachment, in particular a collimating lens system. The purpose of a collimating lens system is to make unaligned or divergent beams of light run parallel to one another and thus form a light beam, which spreads only very slightly over greater distances and is thus ideal for use as a light pointer.

If the output of the emitted electromagnetic radiation is a maximum of 0.8 mW, it is ensured that the retina will not get damaged if the light beam hits the human eye, as the natural lid closing reflex of the eye is usually sufficient to reduce the incoming light beam quickly enough.

A laser diode designed according to the claims has the advantage than it is classified to be in laser hazard class 1 or 2 and is thus permitted for general use in public.

With regard to operating the light module in a highly energy-efficient manner it is an advantage if a second detecting element is provided for measuring the electromagnetic radiation of the surroundings. A light module according to the invention can be used as intended both in daylight and in darkness. With a high level of surrounding brightness to reliably identify the light beam a greater light intensity is necessary than in the dark, for example at night. By means of the design according the claims it is achieved in an advantageous manner that the light beam emitted by the radiation source is of sufficient intensity to stand out from the surroundings. In a less bright environment this has the advantage that the radiation output of the signal source is reduced below the standard level, whereby in an advantageous manner the energy requirement of the radiation source is reduced. By continually adjusting the emitted radiation output the lifetime of the power source can be increased considerably, which is a considerable advantage for compact mobile areas of use of the light module.

An embodiment in which the power source emits a voltage of typically 1.55 V has the advantage that said power source is in the form of widely distributed and thus inexpensive chemical elements, in particular button cells.

The objective of the invention is also to provide a pocket tool which comprises a light module for emitting monochromatic electromagnetic radiation with restricted radiation output.

A pocket tool, in particular a pocket knife, comprises at least one functioning part which can be pivoted out of a storage position by means of which an operation can be performed on a workpiece. Details of the design as well as the advantages of a pocket tool, in particular a pocket knife are not explained in more detail at this point, as they are known to an informed person skilled in the art. Also pocket knives are known from the prior art which comprise light modules, which are designed for short-range lighting.

However, a light module designed according to the invention has the significant advantage that over a greater distance, in particular several meters, a pointing function is possible by means of a light point.

If the light module is formed by a compact, eye-safe light module according to the invention, any damage to the eyes of people who have been unintentionally lit by the light beam is avoided as far as possible by the emitted light beam.

The invention is explained in more detail in the following with reference to the exemplary embodiments shown in the drawings.

In a schematically simplified view:

FIG. 1 shows the light module according to the invention as a block diagram;

FIG. 2*a*, 2*b* show a comparison of a known arrangement of the lighting means and an improvement according to the invention;

Figure 1:
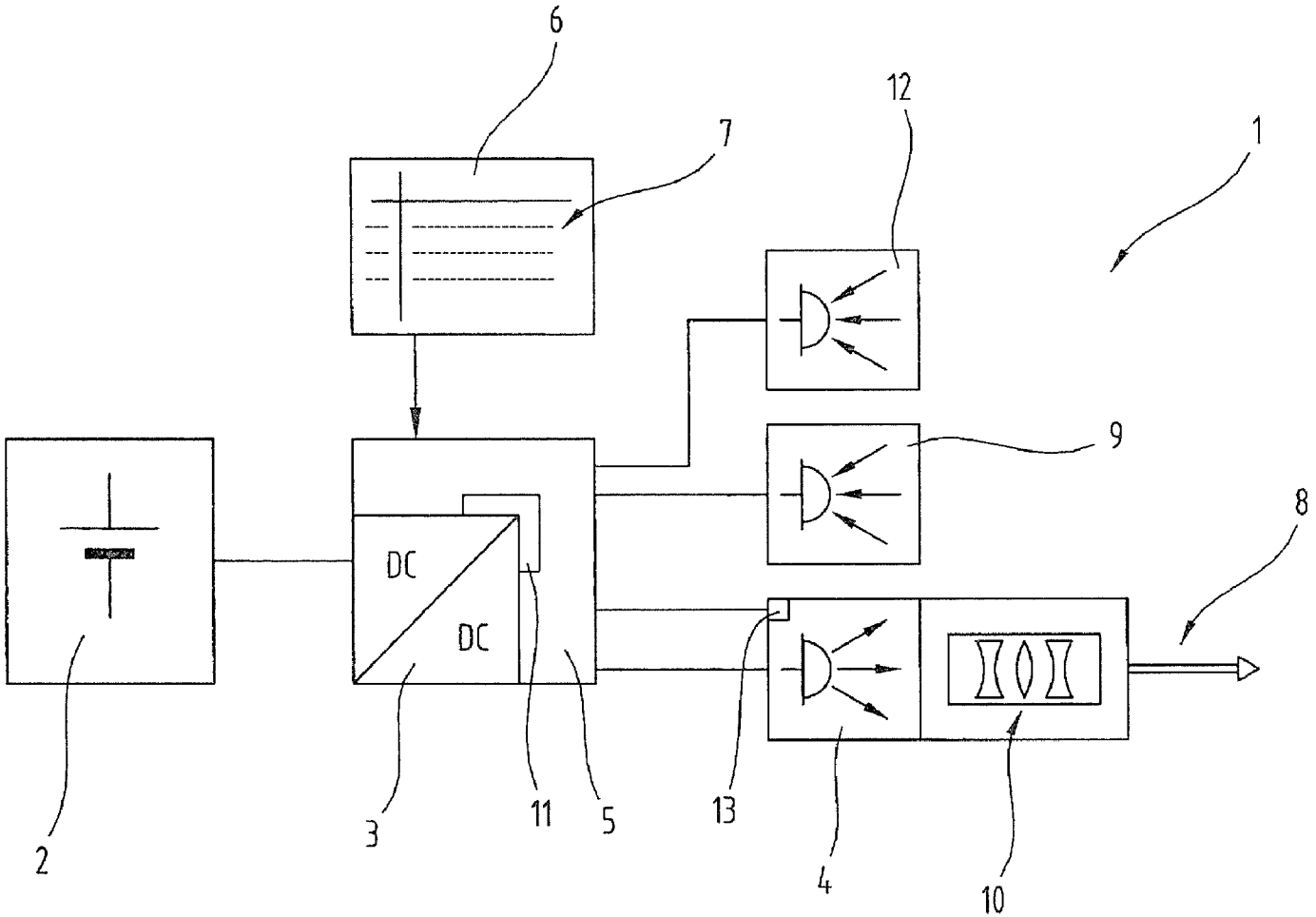

First of all, it should be noted that in the variously described exemplary embodiments the same parts have been given the same reference numerals and the same component names, whereby the disclosures made throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

FIG. 1 shows a block diagram of the light module 1 according to the invention. A power source 2 provides electrical energy at its output, which is converted by the voltage converter 3 to the respectively required supply voltage of the radiation source 4. A power limiter 5 receives operating data 7 from a power configuration module 6 and uses the latter to control the voltage converter 3 specifically, whereby the lighting means 4 emits a light beam 8 with the desired maximum radiation output. Furthermore, a first detecting means for electromagnetic radiation 9 is provided which measures the radiation output actually emitted by the lighting means 4, whereby the measurement value of the power limiter 5 is used as a parameter for controlling the voltage converter 3. As mostly a divergent and non-circular symmetrical light beam is emitted by the lighting means 4, preferably a laser diode, a beam directional optical system 10 is connected after the lighting means 4.

According to classification EN 60825-1 the emitted light beam 8 is designated as a class 2 laser beam, according to which the eye is not at risk of damage during a brief period of radiation and longer exposure is prevented by the natural lid-closing reflex. In particular, the maximum radiation output of the light beam 8 is limited to 0.8 mW. With regard to having a compact structure and the good integration of the light module 1 into existing devices, particularly into pocket tools, the power source 2 is provided by a widely available, standard 1.55 V button cell. However, other types of power source are possible, as by means of the controlled voltage converter 3 the lighting means 4 is supplied continually with the predefined supply voltage, in particular overvoltage is prevented and the associated excessively high radiation output of the light beam 8.

The voltage converter 3 is designed as a step-up and/or step-down converter and thus permits a large usable range of the voltage of the power source 2. In the preferred embodiment of the power source 2 as a 1.55 V button cell the output voltage of the battery is increased to the supply voltage of the lighting means 4. If the output voltage of the power source is too high, for example in the case of a malicious manipulation, the input voltage is reduced or limited to the desired or maximum supply voltage of the lighting means 4. In particular, the voltage converter 3 is able to reduce to a reliable level an input voltage that is up to 400% higher than the nominal supply voltage. The advantage of a step-up or step-down converter is also that it is extremely effective and thus the voltage adjustment can be performed very efficiently, which is very important for the operating life of mobile, battery-powered devices.

The power limiter 5 now performs several functions. In an output configuration module 6 one or more operating data 7 can be stored, by means of which for example the maximum radiation output of the light beam 8 is determined. The operating data 7 of the output configuration module 6 and the radiation power of the radiation emitted by the lighting means 4 determined by the first detecting element for electromagnetic radiation 9 are supplied to a control loop 11 of the power limiter 5 and thus flow into the control of the output voltage of the voltage converter 3. In a further embodiment a second detecting element can be provided for electromagnetic radiation 12, by means of which the intensity of the environmental light is measured. By means of this advantageous development it is possible for example to adjust the output of the emitted light beam 8 specifically to the brightness of the environment. In a dark environment the light beam or the light point hitting an object can already been seen with a low output, whereas in a bright environment a much higher output of the light beam 8 is required. The parameters or threshold values for the specific control of the lighting means can for example also be stored in the operating data 7; the control loop 11 of the power limiter 5 then adjusts the supply voltage of the lighting means according to the respectively detected background brightness, whereby an energy-saving control of the beam intensity is achieved.

In one development the lighting means 4 can also comprise for example a temperature detecting module 13, the measurement value of which also flows into the control of the output voltage of the voltage converter 3. The lighting means 4, in particular a laser diode, heats up during correct operation. If because of external influences the heating becomes excessive the lighting means can get damaged. By detecting the temperature of the lighting means and returning into the control system of the output voltage of the voltage converter an early reduction of the emitted radiation is possible in an advantageous manner. Once the lighting means has returned to a reliable operating temperature, the emitted radiation output can be adjusted at any time to the required default value.

Figure 2A:
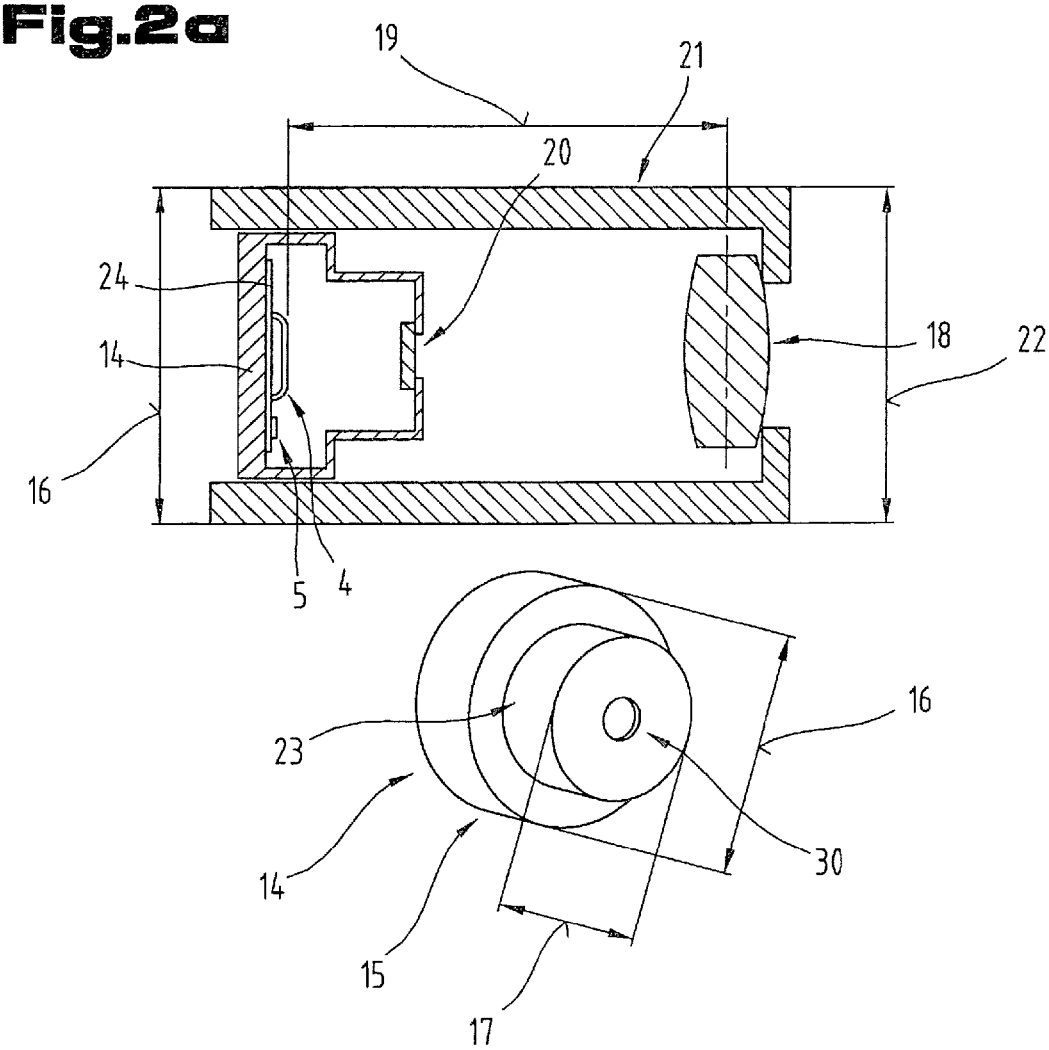
Figure 2B:
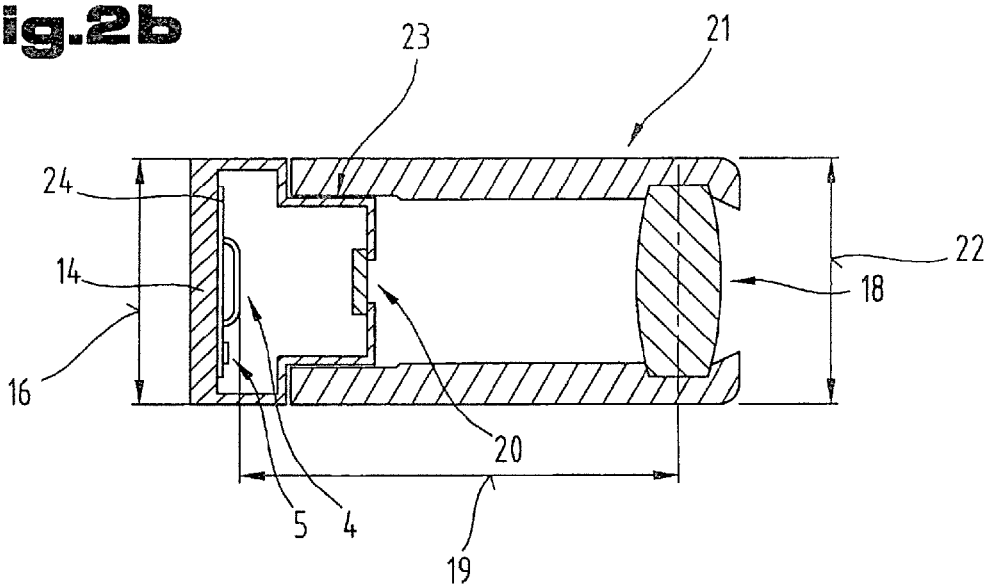

FIGS. 2*a* and 2*b* show a comparison of a known arrangement of a lighting means and an improved arrangement according to the invention.

Widely available and thus inexpensive laser diodes 14 are mostly arranged in a substantially cylindrical housing 15. The housing has an outer diameter 16 and an inner diameter 17.

For shaping the divergent beam emitted by the laser diode, in the beam path a beam directing optical system, in particular a collimating lens 18 is arranged, whereby for focussing a distance 19 has to be maintained between the beam outlet opening 20 and the collimating lens 18. In the known arrangement the collimating lens 18 is arranged in a cylinder attachment 21, preferably adhered and spaced apart by focal distance 19, and the laser diode is arranged in the cylinder attachment. The inner diameter of the cylinder attachment 21 now has to be at least equal to the outer diameter 16 of the laser diode. Owing to the required wall thicknesses to achieve sufficient mechanical stability of the cylinder attachment 21, an outer diameter 22 is much greater than the outer diameter 16 of the laser diode. The preferably used laser diode has an outer diameter 16 of 3.3 mm, whereby according to the previously known arrangement in FIG. 2*a* the smallest possible outer diameter 22 is 4 mm, which is a disadvantage with regard to an arrangement of the light module that is as space-saving and compact as possible.

FIG. 2*b* shows an improvement of the arrangement according to the invention. In this case the cylinder attachment 21 is arranged on the flange-like section 23 of the laser diode. The outer diameter 22 of the cylinder attachment 21 is thus smaller or equal to the outer diameter 16 of the laser diode, which amounts to a considerable saving of space with regard to having a structure that is as compact as possible or with respect to the integration of the light module. The focal distance 19 is thus maintained by the fitting depth of the laser diode. The collimating lens 18 is fixed mechanically in the cylinder attachment 21, preferably by crimping. By means of the improved contact between the cylinder attachment 21 and laser diode in addition improved heat removal is achieved in an advantageous manner.

Further advantages of the improvement according to the invention are that because of the low material requirement, the lighting means has a low weight, which is an advantage with respect to mobile use in a device, for example in a pocket tool 26.

In an advantageous development the light module according to the invention is designed to be integrated so that in the lighting means, in particular on the substrate carrier 24 of the laser diode 14 and/or in the cylinder attachment 21, all elements are arranged for the controlled driving of the laser diode, in particular that is the power limiter 5 with voltage converter and control loop, the power configuration module 6 and at least the first means 9 for detecting electromagnetic radiation. The power source and the integrated lighting means are arranged in a side flange 25 of the pocket tool 26, whereby the electrical connection of the integrated lighting means to the power source is formed by a couplable connecting means. In case of damage to the integrated lighting means such an integrated structure has the particular advantage, that the lighting means can be replaced rapidly and easily.

Figure 3:
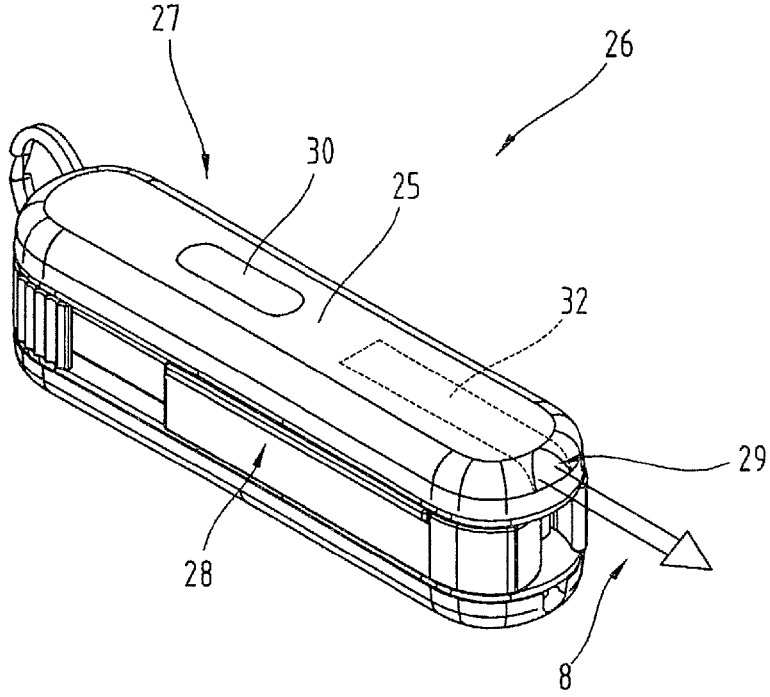
FIG. 3 shows a pocket tool with an integrated light module.

FIG. 3 shows a pocket tool 26, in particular a pocket knife, with a housing 27 and at least one functional element 28. In the housing 27 a light module 1 according to the invention is arranged, also an opening 29 is provided in the housing, at which point the light beam 8 emitted by the light module 1 emerges. In the housing there is also an activating element 30, which is designed for activating the light module. By activating the element 30, in particular by pressing, the voltage converter of the light module 1 is operated and a directed beam 8, in particular a laser beam, is emitted by the lighting means.

Figure 4:
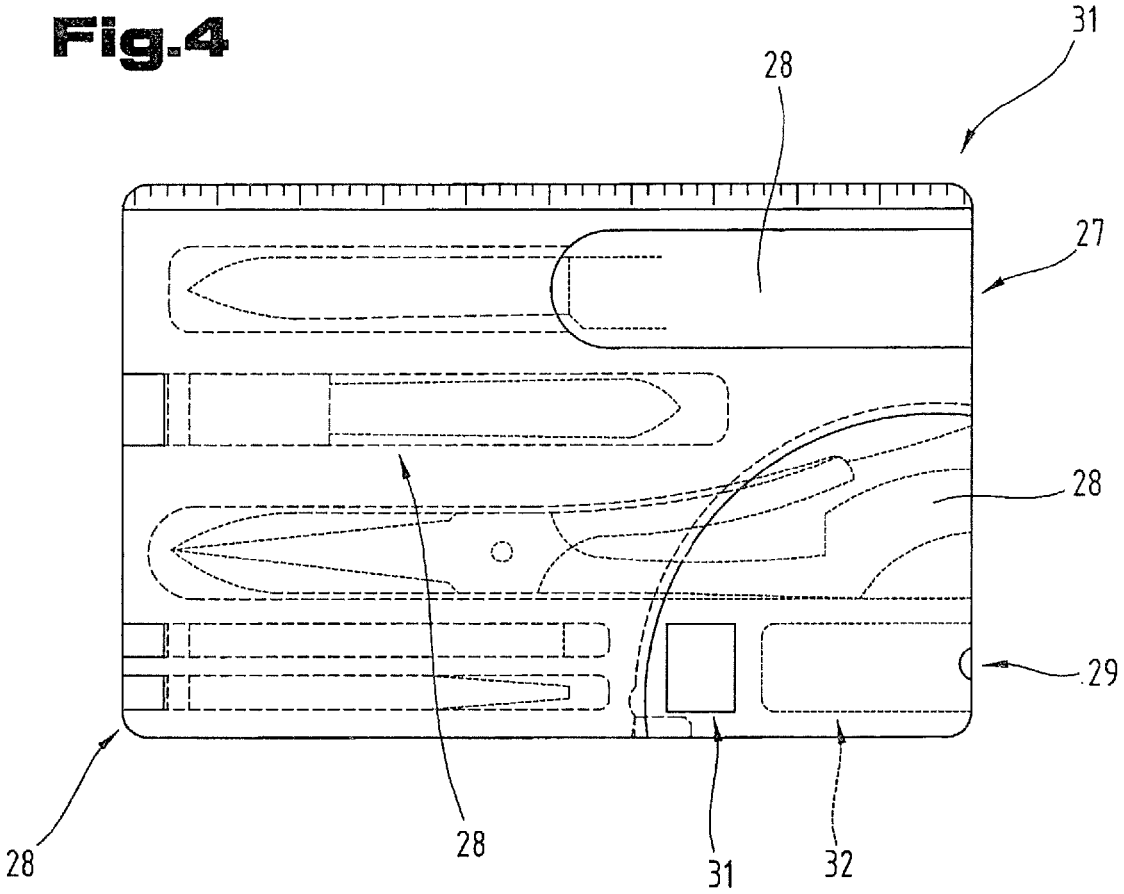
FIG. 4 shows a tool card with an integrated light module.

As shown in FIG. 4, the light module according to the invention in a further embodiment can also be integrated into a tool card 31, the compact structure of the invention being particularly advantageous. The light module 1 is integrated into the housing 27 and is operated by an activating element 30. On an end face edge of the housing there is an outlet opening 29 from which the emitted light beam of the activated light modules emerges.

The exemplary embodiments show possible embodiment variants of the light module, wherein it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the light module, the latter and its components have not been represented true to scale in part and/or have been enlarged and/or reduced in size.

The problem forming the basis of the independent solutions according to the invention can be taken from the description.

Mainly the individual embodiments shown in FIGS. 1 to 4 can form the subject matter of independent solutions according to the invention. The objectives and solutions according to the invention relating thereto can be taken from the detailed descriptions of these figures.

LIST OF REFERENCE NUMERALS

1 Light module
2 Power source
3 Voltage converter
4 Source for electromagnetic radiation
5 Power limiter
6 Power configuration module
7 Operating data/operating parameters
8 Light beam
9 First detecting means for electromagnetic radiation
10 Beam directing optical system
11 Control loop
12 Second detecting means for electromagnetic radiation
13 Temperature detecting module
14 Laser diode
15 Housing
16 Outer diameter
17 Inner diameter
18 Beam shaping optical system/collimating lens
19 Focal distance
20 Protective glass/Beam output opening
21 Cylinder attachment
22 Outer diameter
23 Flange-like section
24 Substrate carrier
25 Side flange
26 Pocket tool/Pocket knife
27 Housing
28 Functional element
29 Radiation outlet opening
30 Activating element
31 Tool card
32 Light module

The invention claimed is:

1. Compact, light module (1) that is substantially eye-safe comprising an electrical power source (2), a voltage converter (3) and a radiation source for electromagnetic radiation (4), also comprising a power limiter (5) for controlling the emitted electromagnetic radiation, characterised in that the power limiter (5) and the radiation source (4) are arranged in an integrated manner and in that the voltage converter (3) is in the form of a step-down and step-up converter.

2. Light module according to claim 1, characterised in that the power limiter (5) comprises a first detecting element for electromagnetic radiation (9).

3. Light module according to claim 1, characterised in that the power limiter (5) comprises a control loop (11).

4. Light module according to claim 2, characterised in that the first detecting element (9) is designed as a photodiode.

5. Light module according to claim 1, characterised in that the first detecting element (9) and the radiation source (4) are arranged to be integrated into one module.

6. Light module according to claim 1, characterised in that the power limiter (5) is designed to influence the output voltage of the voltage converter (3).

7. Light module according to claim 1, characterised in that the power limiter (5) comprises a temperature detecting module (13).

8. Light module according to claim 1, characterised in that the power limiter (5) comprises a power configuration module (6).

9. Light module according to claim 8, characterised in that in the power configuration module (6) operating parameters (7) are stored for the radiation source (4).

10. Light module according to claim 1, characterised in that the radiation source (4) is in the form of a laser diode (14).

11. Light module according to claim 10, characterised in that the laser diode (14) emits electromagnetic radiation with a wavelength of 600 nm to 750 nm, preferably 655 nm.

12. Light module according to claim 10, characterised in that a cylinder attachment (21) is arranged on a flange-like section (23) of the laser diode (14).

13. Light module according to claim 1, characterised in that in the cylinder attachment (21) a beam shaping optical system (18) is arranged, in particular a collimating lens.

14. Light module according to claim 1, characterised in that the output of the emitted electromagnetic radiation is a maximum of 0.8 mW.

15. Light module according to claim 1, characterised in that a second detecting element (12) is provided for measuring the electromagnetic radiation of the environment.

16. Light module according to claim 1, characterised in that the energy source (2) emits a voltage of typically 1.55 V.

17. Pocket tool, with a housing (27) comprising at least one mounting area and at least one functional part (30), which can move out of a storage position inside the mounting area into a position of use outside the mounting area, and with a light module (32) for emitting electromagnetic radiation which is arranged in the housing (27) and can be operated by means of an activating element (30), characterised in that the light module (32) is designed according to claim 1 and is also designed to emit monochromatic electromagnetic radiation with limited radiation output.

* * * * *